US005842646A

United States Patent [19]

Kitajima

[11] Patent Number: 5,842,646

[45] Date of Patent: Dec. 1, 1998

[54] AIR BRUSH

[75] Inventor: Katsuaki Kitajima, Nagano-ken, Japan

[73] Assignee: B.B. Rich Co., Ltd., Nagano-ken, Japan

[21] Appl. No.: 755,913

[22] Filed: Nov. 25, 1996

[30] Foreign Application Priority Data

Apr. 18, 1996 [JP] Japan ..... 8-096791

[51] Int. Cl.[6] ..... B05B 7/30

[52] U.S. Cl. ..... 239/345; 239/346; 239/DIG. 14

[58] Field of Search ..... 222/209, 401; 239/289, 345, 346, DIG. 14

[56] References Cited

U.S. PATENT DOCUMENTS

| | | | |
|---|---|---|---|
| 978,469 | 12/1910 | Mikorey | 239/345 X |
| 4,079,893 | 3/1978 | Bass | 239/346 |
| 4,978,072 | 12/1990 | Kurowski | 239/DIG. 14 |
| 5,190,220 | 3/1993 | Bolton | 239/346 X |
| 5,322,220 | 6/1994 | Rehkemper | 239/214 |
| 5,346,135 | 9/1994 | Vincent | 239/314 |

FOREIGN PATENT DOCUMENTS

| | | |
|---|---|---|
| 61-102584 | 6/1986 | Japan . |
| 6-57447 | 8/1994 | Japan . |

*Primary Examiner*—Andres Kashnikow
*Assistant Examiner*—Robin D. Evans
*Attorney, Agent, or Firm*—Greenblum & Bernstein, P.L.C.

[57] ABSTRACT

To provide an air brush with a function of spraying an ink coating of a writing material, a holder b holding attachably and detachably a writing material a is mounted to an air brush main body 1 having a coating storing vessel 5, a brush tip a1 of the writing material a held by the holder b is adjacently disposed directly in front of a nozzle 2 of the air brush main body 1 at a predetermined angle of inclination whereby the ink coating impregnated in the brush tip a1 is atomized by impinging a jet stream from the nozzle 2 onto the brush tip al.

7 Claims, 4 Drawing Sheets

AIR BRUSH

BACKGROUND OF THE INVENTION

1. Field of the Invention

The present invention relates to an air brush having a function of spraying a coating fed from a coating storing vessel as well as a function of spraying an ink coating impregnated in a brush tip of a writing material such as a felt pen or the like.

2. Description of Related Art

Conventionally, an air brush used in graphic design or fine coating etc. is provided with a coating vessel such as a coating cup at an air brush main body that is formed substantially in a shape of a pen and a coating fed from the coating cup to a nozzle is atomized by blowing compressed air and is sprayed as extremely fine particles.

Meanwhile, there has been a conventional simplified blowing device which atomizes an ink coating impregnated at a pen tip of a writing material such as a felt pen, a sign pen or the like and sprays it similar to an air brush, as disclosed in, for example, Japanese Unexamined Utility Model Publication No. Sho 61-102584 or Japanese Unexamined Utility Model Publication No. Hei 6-57447.

According to the above-mentioned simplified blowing device a writing material such as a felt pen etc. is mounted attachably and detachably to the main body of the blowing device having a nozzle at its front end and a pen tip thereof is held in a state where it is adjacently disposed directly in front of the nozzle at a predetermined angle.

According to the above-mentioned simplified blowing device compressed air supplied from a bomb, a compressor or the like is blown from the nozzle, and a jet stream thereof is made to impinge on the pen tip of the writing material at a pertinent angle whereby the coating impregnated in the pen tip is atomized and sprayed.

The above-described simplified blowing device is constituted exclusively for spraying the ink coating impregnated in a writing material such as a felt pen etc. in which a mode of directly spraying the ink impregnated in an existing writing material from the pen tip is adopted and accordingly, it has an advantage capable of simplifying the structure of the nozzle that is the major portion of the blowing device. Further, according to the above-mentioned simplified blowing device time and labor for cleaning the coating adhered to a coating vessel or the nozzle portion after using the device can be dispensed with and therefore, it can be used more easily than other conventional air brush.

However, according to the above-described simplified blowing device the structural components of the nozzle or others are designed in comparatively simplified forms and therefore, the spray state of the ink coating is not fine and the device is significantly inferior in respect of the function to an air brush in which important nozzle, needle and the like are finely constituted.

SUMMARY OF THE INVENTION

It is an object of the present invention to rationally provide an existing air brush with a function of spraying an ink coating of a writing material and to realize good quality spray utilizing the writing material.

In order to resolve the above-described problem, according to a first aspect of the present invention there is provided an air brush in which a coating storing vessel is installed to an air brush main body and a coating fed from the coating storing vessel is atomized at a nozzle portion and is sprayed along with blown compressed air, wherein a holder holding attachably and detachably a writing material such as a felt pen or the like is mounted to the air brush main body and a brush tip of the writing material held by the holder is adjacently disposed directly in front of the nozzle of the air brush main body at a predetermined angle.

According to a second aspect of the present invention the air brush may be provided with the coating storing vessel at an upper portion on a side of a front end of the air brush main body and the holder may be fitted attachably and detachably to an outer peripheral portion of the coating storing vessel.

Further, according to a third aspect of the present invention, the holder of the air brush may be provided with an adjusting means for adjusting the brush tip of the writing material held by the holder to move closely and remotely in respect of a front end of the nozzle.

According to the first aspect of the air brush, the holder mounted to the air brush main body holds attachably and detachably the writing material such as a felt pen or the like and holds the brush tip to adjacently dispose directly in front of the nozzle of the air brush main body at a predetermined angle.

Therefore, when compressed air is jetted from the nozzle and the jet stream passes in close proximity of the writing material at a predetermined angle, the coating impregnated in the brush tip is absorbed, atomized and sprayed in a spray pattern by the negative pressure of the jet stream.

According to the second aspect of the air brush the coating storing vessel is installed at the upper portion on the side of the front end of the air brush main body and the holder is fitted attachably and detachably to the outer peripheral portion of the coating storing vessel and therefore, the holder of a writing material can be mounted with certainty by utilizing the coating storing vessel provided to the air brush main body and can be attached thereto and detached therefrom easily.

According to the third aspect of the air brush the adjusting means for adjusting the brush tip of a writing material to move closely and remotely in respect of the front end of the nozzle and accordingly, the intensity of the jet stream directed from the nozzle to the brush tip of the writing material can be adjusted by changing a distance between the nozzle and the brush tip of the writing material and the amount of the coating absorbed from the brush tip can be adjusted in accordance with the intensity.

DETAILED DESCRIPTION OF THE PREFERRED EMBODIMENTS

An explanation will be given of an embodiment of the present invention based on the drawings as follows.

Figure 1:
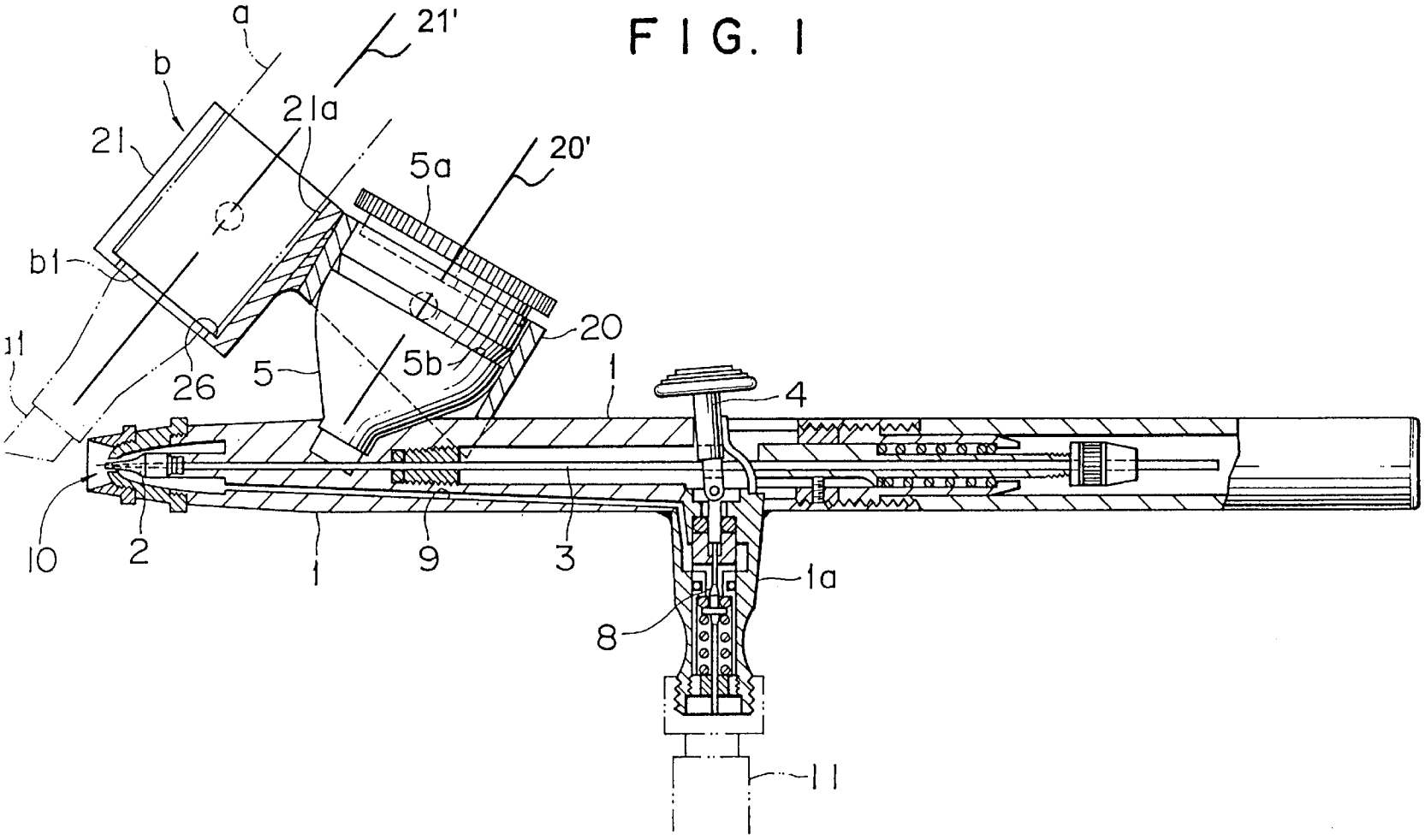
FIG. 1 is a side view showing an air brush in accordance with an embodiment of the present invention by partially cutting it.
Figure 2:
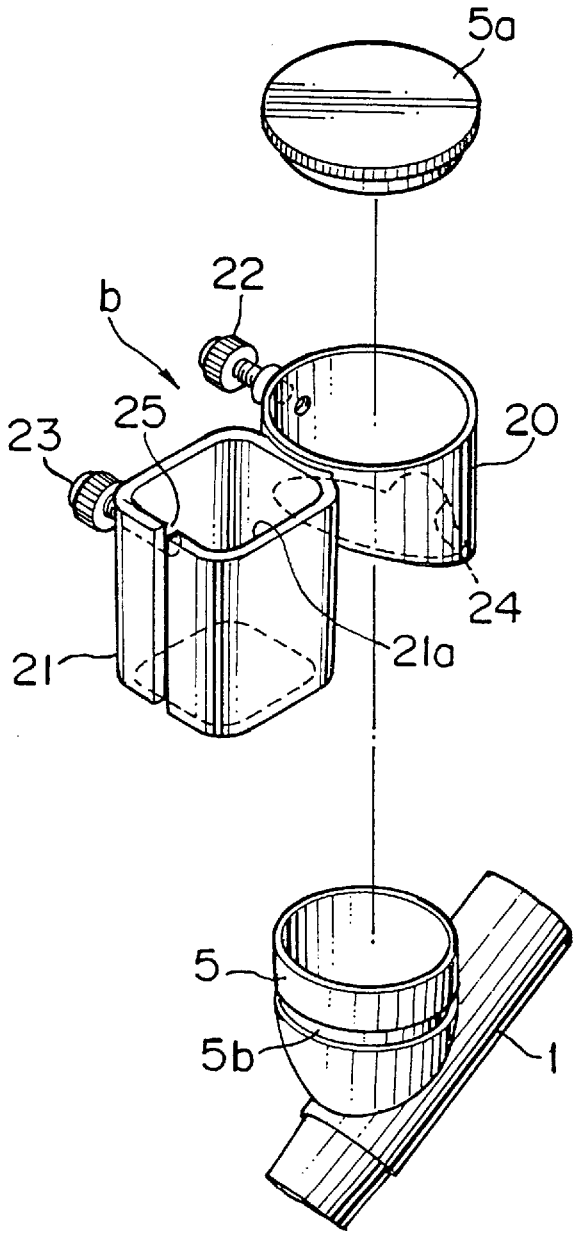
FIG. 2 is a perspective view showing a holder.
Figure 3:
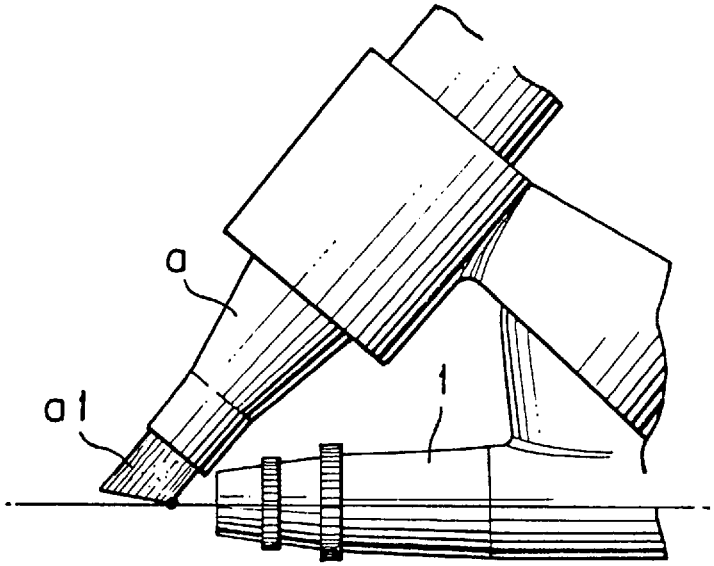
FIG. 3 is a side view showing a pen tip of a writing material and a front end portion of an air brush.

An air brush illustrated in FIG. 1 has functions whereby it can be used alternatively for spraying a liquid coating stored in a coating cup 5 or for spraying an ink coating impregnated in a writing material a of a felt pen etc.

The air brush is coaxially provided with a blow hole 10 of the coating and a nozzle 2 at the front end of an air brush main body 1 formed in a substantially cylindrical shape and a needle 3 arbitrarily opening and closing the nozzle 2 is inserted into the air brush main body 1 extratively and detractively in an abrasive fashion along the core axis portion of the air brush main body.

The needle 3 is supported movably in the axial direction by inclining an operating stick 4 installed at an intermediate portion of the air brush main body 1. When the needle 3 is retracted by inclining the operating stick 4, a liquid coating is fed from a coating cup 5 installed at the upper portion on the front end side of the air brush main body 1 toward the nozzle 2.

Meanwhile, a connecting cylinder 1*a* is integrally connected to an intermediate portion of the air brush main body 1 and a supply hose 11 of compressed air is attachably and detachably screwed and connected to a lower end port of the connecting cylinder 1*a*. Further, an air valve 8 is installed inside of the connecting cylinder 1*a* and the air valve 8 is opened by pushing down the operating stick 4.

When the air valve 8 is opened by pushing down the operating stick 4 as described above, compressed air flows in from the connecting cylinder 1*a* constituting an air supply port toward the inside of the air brush main body 1 and flows out from the blow hole 10 after passing through a vent path 9 provided in the main body 1 and the nozzle 2.

According to the above-described air brush compressed air is jetted and at the same time the liquid coating fed from the coating cup 5 is atomized and sprayed from the nozzle 2 by pushing down the operating stick 4 and inclining it rearwardly.

As illustrated in FIG. 1 the coating cup 5 is integrally installed at the portion on the front end side of the air brush main body 1 in a state where the coating cup 5 is inclined rearwardly. The coating cup 5 functions as a vessel storing the coating and also functions as a support member fixedly supporting a holder b for holding the writing material a.

The holder b holding the writing material a is constituted by an attaching cylinder 20 fitted to the outer periphery of the coating cup 5 and a holding cylinder 21 holding the writing material a by inserting it thereinto and the outer peripheries of the both cylinders 20 and 21 are integrally bonded.

The attaching cylinder 20 is a cylinder fitted to the outer periphery of the coating cup 5 via a pertinent fitting, of which lower end opening edge is obliquely cut and a positioning fitting portion 24 having a substantially semicircular arc form for fitting from above to the outer periphery of the air brush main body 1, is recessed at the rear side portion of the lower end opening edge.

The holding cylinder 21 is a cylinder holding the object of the writing material a by inserting it thereinto and the cylinder has an inserting hole 21*a* in compliance with the outer peripheral shape of the writing material a and is integrally bonded to an outer peripheral portion of the attaching cylinder 20 opposed to the positioning fitting portion 24.

The holding cylinder 21 in accordance with the embodiment is the cylinder provided with the inserting hole 21*a* in a substantially rectangular form for inserting the writing material a having a longitudinal sectional face of a substantially rectangular form and a slit 25 is notched at the outer peripheral face thereof opposed to the portion thereof bonded to the attaching cylinder 20.

The slit 25 is for elastically deforming the inserting hole 21*a* such that the dimension in the width direction of the insertion hole 21*a* is slightly widened when the writing material a is inserted into the inserting hole 21*a* and the resistance in inserting the writing material a is maintained in a pertinent range by utilizing the elastic deformation.

The holder b constituted as above is bonded attachably and detachably to the air brush main body 1 by fitting the attaching cylinder 20 to the outer periphery of the coating cup 5 installed to the air brush main body 1.

According to the holder b the attaching cylinder 20 is fitted to the outer periphery of the coating cup 5 and at the same time the positioning fitting portion 24 provided at the lower end opening edge of the attaching cylinder 20 is fitted to the outer periphery of the air brush main body 1 from above whereby the axes of the attaching cylinder 20 and the holding cylinder 21 are accurately disposed along the core axis of the air brush main body 1 in respect of the plane view.

Further, in respect of the side view the holding cylinder 21 is bonded to the attaching cylinder 20 such that a core axis 21' of the holding cylinder 21 is inclined to a core axis 20' of the attaching cylinder 20 at a predetermined angle whereby the writing material a mounted in the fitting hole 21*a* of the holding cylinder 21 is held at a predetermined angle of inclination in respect of the core axis of the air brush main body 1 (FIG. 1).

Accordingly, when the writing material a is inserted into the holding cylinder 21 of the holder b mounted to the air brush main body 1 as described above, a pen tip a1 thereof is disposed on the core axis of the air brush main body 1 in respect of the plane view and made to be in a state where it is projected directly in front of the blow hole 10 at the front end of the air brush main body 1 at a predetermined angle of inclination.

The above-mentioned angle of inclination of the pen tip a1 indicates an angle at which the jet stream jetted from the nozzle 2 impinges on the pen tip al whereby proper atomization is carried out, that is, an angle of intersection of the core axis of the pen tip al and the core axis of the nozzle 2. Although the angle differs slightly depending on the shape, thickness or the like of the pen tip, in the case of this embodiment the angle between the core axis of the nozzle 2 and the core axis of the pen tip a1 is set to about 50° (±10°).

A stopper face 26 is projectingly formed at the inner peripheral edge of the lower end opening in he holding cylinder 21 of the holder b. The stopper face 26 is for restricting the position of insertion of the writing material a by making a cap butting face b1 formed in the writing material a stop thereby when the writing material a is inserted into the inserting hole 21*a* of the holding cylinder 21 from above.

Therefore, when the writing material a is inserted into the inserting hole 21*a* of the holding cylinder 21 and the cap butting face b1 is stopped by the stopper face 26, the pen tip a1 is necessarily stopped at the best position, that is, a position at which a corner portion of the pen tip a1 is brought into contact with an extended line of the nozzle 2.

Fixing screws 22 and 23 are installed at sides of the outer peripheral portions of the attaching cylinder 20 and the holding cylinder 21 of the holder b and the front ends of the respective screws 22 and 23 are projected to the side of the inner peripheries of the respective cylinders 20 and 21.

The fixing screw 22 on the side of the attaching cylinder 20 is pressed into an engaging groove 5*b* recessed at the outer periphery of the coating cup 5 by manually fastening it and functions as a detachment stopper of the attaching cylinder 20.

The section of the engaging groove 5*b* is formed in a tapered shape as illustrated in FIG. 1 and when the fixing screw 22 is fastened, the front end of the screw 22 is brought into contact with the tapered face of the engaging groove 5*b* whereby the holder b per se can be prevented from shifting upwardly.

Meanwhile, the fixing screw 23 on the side of the holding cylinder 21 prevents the writing material a from shifting by pressing the outer peripheral face of the writing material a. Further, when a writing material (not illustrated) having a diameter slightly smaller than that of the writing material a is used, such a writing material can be fastened and fixed in the inserting hole 21*a* with no play by the fixing screw 23.

Figure 4:
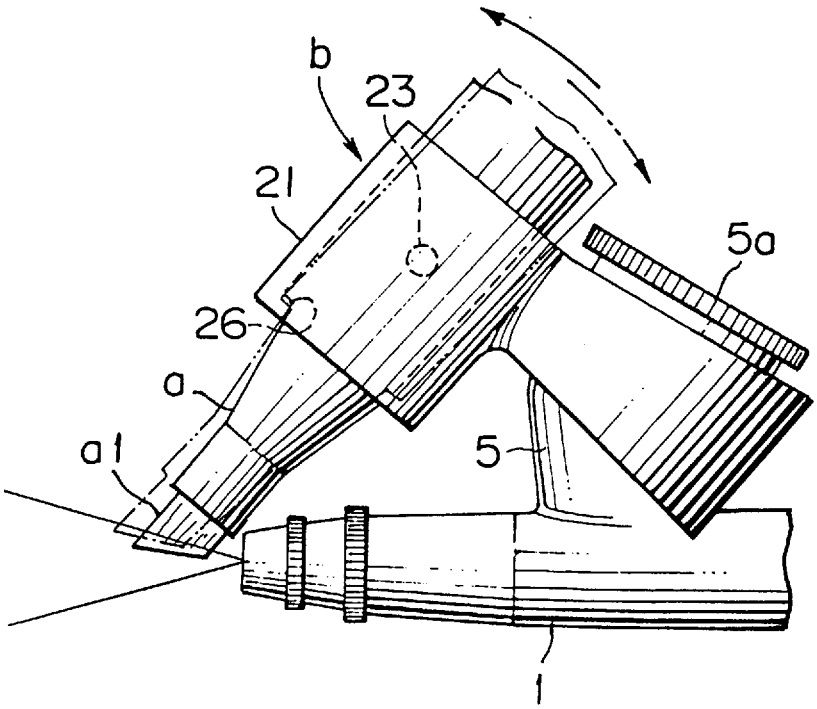
FIG. 4 is a side view showing a front end portion of an air brush in a state where a writing material is mounted to a holder.

A tapered clearance whereby the dimension in the forward and rearward direction is widened toward the upper end opening is provided at the inserting hole 21*a* of the holder b(FIG. 4). Thereby, the writing material a inserted into the inserting hole 21*a* can be inclined within the range of the clearance in respect of the core axis direction of the air brush main body 1 and further, can be fixed at an arbitrarily inclined position by fastening the fixing screw 23 (FIG. 4).

As described above the distance between the pen tip a1 of the writing material a and the nozzle 2 at the front end of the air brush main body 1 can finely be adjusted by inclining the writing material a inserted into the inserting hole 21*a* within the range of the clearance.

The distance between the pen tip a1 and the nozzle 2 is concerned with the intensity of the air stream impinged on the pen tip al. That is, when the distance is reduced, the jet stream of compressed air impinged on the pen tip a1 is intensified and the amount of the ink coating sprayed from the pen tip a1 is increased.

Incidentally, the amount of the ink coating sprayed from the pen tip a1 can be arbitrarily adjusted by increasing or decreasing the amount of blow of compressed air by operating the operating stick 4. However, when the remaining amount of the ink coating impregnated in the writing material a is reduced by using it, the absolute amount of the ink coating sprayed from the pen tip a1 is reduced as described above. When the remaining amount of the ink coating is reduced and the absolute amount of ink coating sprayed from the pen tip a1 is reduced, the writing material a may be adjusted to incline as described above whereby the pen tip a1 is made approach slightly to the nozzle 2. In this way the absolute amount of the ink coating sprayed from the pen tip a1 can be maintained at the amount in the initial state of using and a substantially constant amount of spray can be maintained until the ink coating is almost exhausted.

With regard to the writing material a mounted to the air brush, many kinds thereof having different colors or different shapes of the pen tip may be prepared and the operation may be carried out while simply changing the color of the sprayed ink coating or the spray mode by interchanging them as necessary.

Figure 5A:
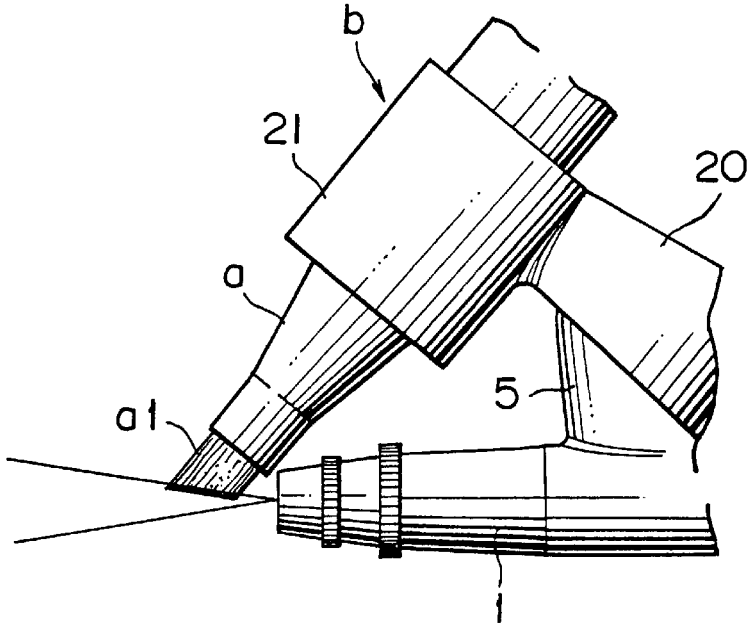
FIGS. 5(*a*) and 5(*b*) are side views showing a front end portion of an air brush in a state where a writing material is mounted to a holder in which FIG. 5(*a*) illustrates an air brush mounted with a writing material having a thick pen tip and FIG. 5(*b*) illustrates an air brush mounted with a writing material having a thin pen tip.
Figure 5B:
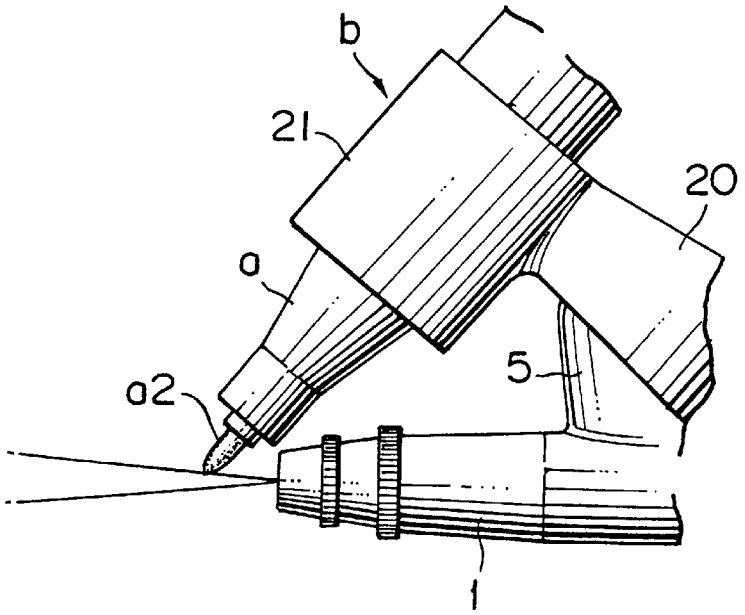

For example, when a writing material having a thick pen tip a1 is mounted as illustrated in FIG. 5(*a*), a comparatively large amount of spray can be carried out and therefore, it is suitable for spraying in a wide range. Further, when a writing material having a thin pen tip a2 is mounted as illustrated in FIG.5(*b*), the amount of spray of the ink coating is small and therefore, it is suitable for the case where comparatively thin lines are sprayed, or the like. Also, the above-described air brush can be utilized as a normal air brush when the holder b is removed from the coating cup 5.

Incidentally, a felt pen having a pen tip comprising felt, a sign pen or a marker pen having a pen tip constituted by a bundle of one-directional fiber, etc. are pertinent as the writing material a that is used in the air brush of the present invention. However, any kinds of pens may be used so far as they are writing materials capable of spraying ink coating impregnated in pen tips by blowing compressed air.

Although the outer peripheral shape of the writing material a used in the above-described embodiment is substantially rectangular, the shape or the size of a writing material mounted to the holder is arbitrary. For example, when a writing material having a circular outer peripheral shape or other shape is used, other holder in which the shape of the inserting hole of the holding cylinder corresponds to the outer peripheral shape of the used writing material, may be used, or a cylindrical adapter having an inner peripheral shape the same as the outer peripheral shape of the writing material a may be fitted onto the outer periphery of the used writing material and the writing material may be inserted into the inserting hole 21*a* of the holder b via the adapter (not illustrated).

Although in the above-described embodiment the holder b is fixedly supported by the air brush main body 1 by fitting the holder b onto the outer periphery of the coating cup 5, the mounting style of the holder in respect of the air brush main body is not limited thereto but any structure may be used so far as the holder can be mounted attachably and detachably onto the air brush main body 1. For example, the holding cylinder of the holder may be mounted attachably and detachably onto a portion of the air brush main body 1 between the front end portion thereof and the coating cup.

As has been explained, the air brush in accordance with the first aspect of the present invention is provided with the holder holding the writing material such as a felt pen etc. at the air brush main body and the brush tip of the writing material held by the holder is adjacently disposed directly in front of the nozzle at a predetermined angle. Therefore, not only the inherently conducted fine coating is carried out by using the coating storing vessel but also it can simply be used for spraying an ink coating impregnated in a writing material from the brush tip by mounting the writing material using the holder.

Accordingly, the range of the use of the air brush can be widened and further, the spraying of an ink coating by utilizing a writing material as well as utilization of the function of a fine nozzle provided to the air brush can be carried out and therefore, a finer and more massive spray state can be provided than that by the conventional exclusive simplified blowing device.

According to the air brush in accordance with the second aspect of the present invention, the holder is attachably and detachably mounted to the coating storing vessel of the air brush main body and accordingly, the holder of a writing material can simply and firmly be mounted by utilizing the coating storing vessel provided to the air brush main body. Accordingly, it can be realized at a low cost that the mode of spray where the holder is provided to the air brush main body and the ink coating of the writing material is utilized, is used without significantly changing the style of the conventional air brush. Further, when the holder is removed, it can be used similar to the conventional air brush.

According to the air brush in accordance with the third aspect of the present invention, the adjusting means for adjusting to move the brush tip of a writing material held by the holder in respect of the front end of the nozzle, is provided and accordingly, by adjusting the distance between the nozzle and the brush tip the intensity of the jet stream impinged from the nozzle onto the brush tip of the writing material can be adjusted whereby the amount of the coating absorbed from the brush tip can be adjusted. As a result, for example, the phenomenon in which the amount of the spray from the brush tip is reduced when the remaining amount of the ink coating stored in the writing material is reduced can be compensated for by adjusting the position of the brush tip by the adjusting means whereby a constant amount of blow can always be maintained.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope and spirit of the invention as defined by the appended claims.

What is claimed is:

1. An air brush in which a coating storing vessel is installed to an air brush main body and a coating fed from the coating storing vessel may be atomized at a nozzle portion and sprayed along with blown compressed air, wherein a holder holding attachably and detachably a writing material is mounted to the air brush main body and a brush tip of the writing material held by the holder is adjacently disposed directly in front of the nozzle of the air brush main body at a predetermined angle, ink of said writing material being sprayed along with blown compressed air in lieu of said coating.

2. The air brush according to claim 1, wherein the coating storing vessel is installed at an upper portion on a side of a front end of the air brush main body and the holder is attachably and detachably fitted to an outer peripheral portion of the coating storing vessel.

3. The air brush according to claim 1, wherein the holder is provided with an adjusting means for adjusting the brush tip of the writing material held by the holder to move closely and remotely in respect of a front end of the nozzle.

4. The air brush according to claim 2, wherein the holder is provided with an adjusting means for adjusting the brush tip of the writing material held by the holder to move closely and remotely in respect of a front end of the nozzle.

5. The air brush according to claim 1, wherein said writing material comprises a felt pen.

6. The air brush according to claim 1, wherein said writing material comprises a pen having an ink coating impregnated in a pen tip of the pen.

7. The air brush according to claim 1, wherein said writing material comprises a pen having a pen tip including a bundle of one-directional fiber.

* * * * *